US006047863A

United States Patent [19]

Kanzler et al.

[11] Patent Number: 6,047,863

[45] **Date of Patent: *Apr. 11, 2000**

[54] APPARATUS AND AGITATOR FOR DISPENSING FLUENT MATERIAL INTO CONTAINERS

[75] Inventors: Estacia Kanzler; James J. Kanzler, both of Round Lake; Jack D. Eiler, Ingleside, all of Ill.

[73] Assignee: The Sandbagger Corporation, Round Lake, Ill.

[ * ] Notice: This patent is subject to a terminal disclaimer.

[21] Appl. No.: 09/225,609

[22] Filed: Jan. 5, 1999

Related U.S. Application Data

[63] Continuation of application No. 09/058,424, Apr. 9, 1998, which is a continuation-in-part of application No. 08/585, 219, Jan. 11, 1996, Pat. No. 5,740,950.

[51] Int. Cl.[7] ..... G01F 11/20

[52] U.S. Cl. ..... 222/238; 141/313; 222/334; 222/413

[58] Field of Search ..... 222/238, 413, 222/333, 334, 179; 141/313, 319, 68, 247

[56] References Cited

U.S. PATENT DOCUMENTS

| | | | |
|---|---|---|---|
| 2,650,002 | 8/1953 | Farley . | |
| 2,872,080 | 2/1959 | Thene . | |
| 3,093,271 | 6/1963 | Douglas . | |
| 3,111,242 | 11/1963 | Reed | 222/238 |
| 3,187,958 | 6/1965 | Swart . | |
| 3,258,165 | 6/1966 | Guyer | 222/238 |
| 3,310,205 | 3/1967 | Meyer . | |
| 5,417,261 | 5/1995 | Kanzler et al. . | |
| 5,437,318 | 8/1995 | Kanzler et al. . | |
| 5,740,950 | 4/1998 | Kanzler et al. . | |
| 5,771,665 | 6/1998 | Nelson et al. . | |
| 5,806,576 | 9/1998 | Sutherlin . | |
| 5,832,348 | 11/1998 | Rankin . | |

*Primary Examiner*—Philippe Derakshani
*Attorney, Agent, or Firm*—Thomas R. Vigil

[57] ABSTRACT

The fluent material dispensing apparatus for dispensing fluent material comprises: a hopper for receiving and holding, subsequent to discharge, a quantity of fluent material and having an open top and a closed bottom; at least one fluent material discharge chute which is connected to the bottom of the hopper, which extends downwardly from the bottom and which has an upper material receiving opening and a lower material discharge opening; support structure for supporting the hopper above ground; a mechanism for blocking and unblocking the at least one discharge chute including a plate reciprocal in a path which contains the plate and which extends laterally, transversely across the at least one discharge chute, in a generally horizontal direction across the chute, between a chute blocking position and a chute unblocking position; engageable structure coupled to the plate and being constructed and arranged for being engaged for reciprocating the plate in the path extending generally horizontally across the chute; a rotatable auger adjacent the bottom of the hopper for moving fluent material over the at least one discharge chute; a rotatable agitator mounted in the hopper for agitating fluent material received in the hopper; and, a power supply for rotating the auger and for rotating the agitator within the hopper.

9 Claims, 6 Drawing Sheets

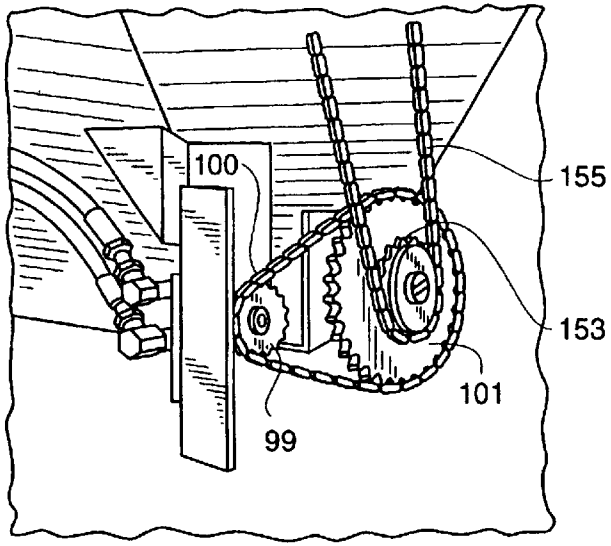
FIG. 8
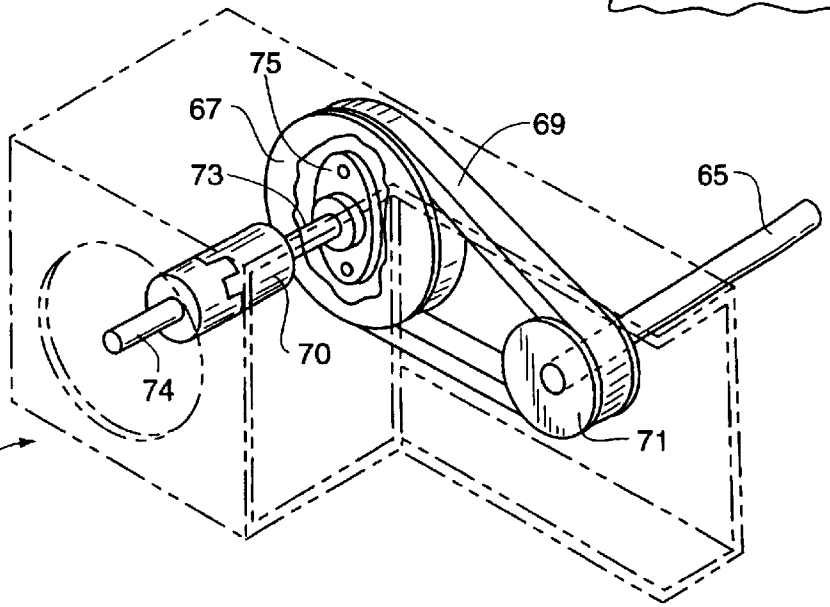
FIG. 9
FIG. 7
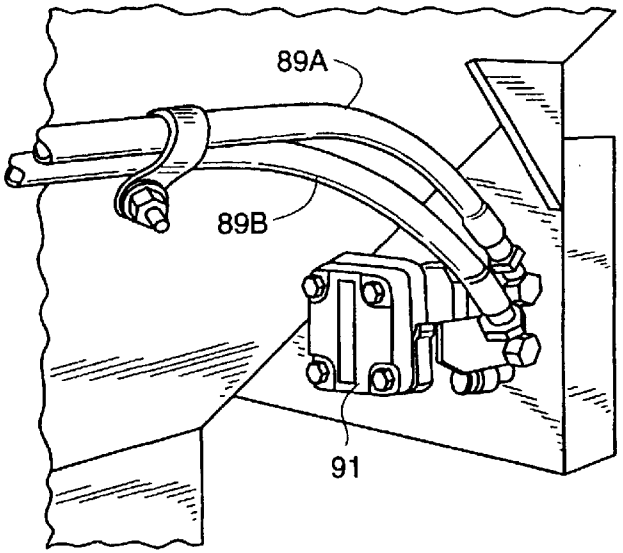

APPARATUS AND AGITATOR FOR DISPENSING FLUENT MATERIAL INTO CONTAINERS

CROSS-REFERENCE TO RELATED APPLICATIONS

This application is a Continuation of U.S. Ser. No. 09/058,424 filed Apr. 9, 1998, which is a Continuation-In-Part of U.S. Ser. No. 08/585,219 filed Jan. 11, 1996, now U.S. Pat. No. 5,740,950.

FIELD OF THE INVENTION

This invention relates to devices and apparatus for dispensing fluent material into containers. More particularly, this invention relates to a power-driven device having an agitator and auger apparatus which can fill bags, boxes or other containers with sand, cement, rocks, soil, grain, chemicals or other fill material. Moreover the device has particular safety features to reduce the possibility of accidental injury to the user of the apparatus.

BACKGROUND OF THE INVENTION

U.S. Pat. No. 5,417,261, Kanzler et al., teaches a fluent material dispensing apparatus having a hopper for receiving and holding fluent material. As used herein, "fluent material" means material which flows or is capable of flowing and is made up of relatively small particles, such as powders, sand, gravel, rocks, pebbles, dirt, soil, limestone wastes, cement, grain, fertilizer or any other granular or powdery material. The invention taught in the '261 patent relies on gravity as a means to dispense the fluent material in the hopper. The invention of the '261 patent has the disadvantage of not working at optimal efficiency when the fluent material is wet, in which case the material often becomes clogged in the discharge openings at the bottom of the hopper. U.S. Pat. No. 5,437,318, Kanzler et al., teaches an improvement to the '261 patent. The '318 patent includes a rotatable auger that moves the fluent material over the discharge openings thereby improving the efficiency of the invention by breaking up wet fluent material.

This invention teaches improvements on the '318 and '261 patents. In particular, the invention teaches an apparatus having an agitator, which churns the fluent material to allow it more readily to pass through the discharge openings. When used in addition to the auger taught by the '261 patent, the apparatus' efficiency is greatly increased. The agitator shaft is centrally located in the hopper and rotates to insure a steady flow of material to the auger and discharge chutes. The auger rotates to direct the filler material toward the discharge chutes. The rotation of the auger maintains an even flow of filler material through the discharge chutes. The invention also teaches the utilization of a means to drive the agitator. One embodiment of the power means comprises of an engine or motor connected to a hydraulic pump and hydraulic motor system, and a means to control the three states of the agitator, clockwise rotation, counter-clockwise rotation and no rotation. The power means may drive both the auger and agitator in an harmonious fashion to further increase the apparatus' efficiency. Finally, the invention also teaches a grid covering the top of the hopper to reduce the possibility of injury to users of the invention.

Although, other material handling devices are well known, such conventional equipment requires extensive material transmission apparatus and is not readily portable or self-contained. Furthermore, other material handling devices similar to the present invention do not teach a portable and efficient, power-drive mechanism for rotating an auger and agitator to increase the efficiency of moving fluent material to the discharge openings so that blockages are eliminated and fluent material flows constantly to the discharge openings.

SUMMARY OF THE INVENTION

According to the present invention, there is provided a fluent material dispensing apparatus for dispensing fluent material comprising:

- a hopper for receiving and holding, subsequent to discharge, a quantity of fluent material and having an open top and a closed bottom;
- at least one fluent material discharge chute which is connected to the bottom of the hopper, which extends downwardly from the bottom and which has an upper material receiving opening and a lower material discharge opening;
- support structure for supporting the hopper above ground;
- a mechanism for blocking and unblocking the at least one discharge chute including a plate reciprocal in a path which contains the plate and which extends laterally, transversely across the at least one discharge chute in a generally horizontal direction across the chute between a chute blocking position and a chute unblocking position;
- engageable structure coupled to the plate and being constructed and arranged for being engaged for reciprocating the plate in the path extending generally horizontally across the chute;
- a rotatable auger adjacent the bottom of the hopper for moving fluent material over the upper material receiving opening of the at least one discharge chute;
- a rotatable agitator including a rotatable shaft and two or more blades or tines extending outwardly from the shaft mounted in the hopper for agitating fluent material received in the hopper; and,
- a power supply for rotating the auger and for rotating the agitator within the hopper. This invention overcomes the problems encountered by blockages often caused by moisture content within the fluent material. At the same time, this invention teaches a machine which is readily portable, having a self-contained auger and agitator power system.

The power system taught by this invention combines a conventional power source, such as a small-bore engine, with a hydraulic system, including a hydraulic pump and motor, connected by power transmission apparatus, to drive the auger and agitator. This relatively lightweight power system provides a material dispensing device that is easily portable on a trailer or in a truck bed, so that it may be taken on short notice to places where flooding occurs, or other form of material dispensing is needed.

Material handling devices of a screw conveyor type are known, an example of a device of this type is illustrated in the Douglas U.S. Pat. No. 3,093,271. However, that device has the shortcomings of requiring multiple augers necessary to discharge the filler material and also does not disclose a power-driven mechanism for rotating the auger. Similarly, French Patent No. 2641-262-A teaches a series of three augers adjacent to each discharge chute to reduce the risk of blockages. That device has the limitation that excessive numbers of augers are needed to discharge material from the hopper. Conversely, the present invention teaches a single auger and agitator which traverse the hopper and move fill material to the multiple discharge chutes.

BRIEF DESCRIPTION OF THE DRAWINGS

These and other features of the invention will now be described with reference to the drawings of the preferred embodiment which is intended to illustrate and not to limit the invention. In the accompanying drawings that form a part of the specification, the numerals and letters refer to terms and elements of the invention discussed below in the detailed description of the invention:

FIG. 7 is a perspective view of the hydraulic motor showing the underside of the hopper.

FIG. 8 is a perspective view of the chain drive system.

FIG. 9 is a perspective view of the belt drive system of the invention's auger power means.

DESCRIPTION OF THE PREFERRED EMBODIMENT(S)

Figure 11:
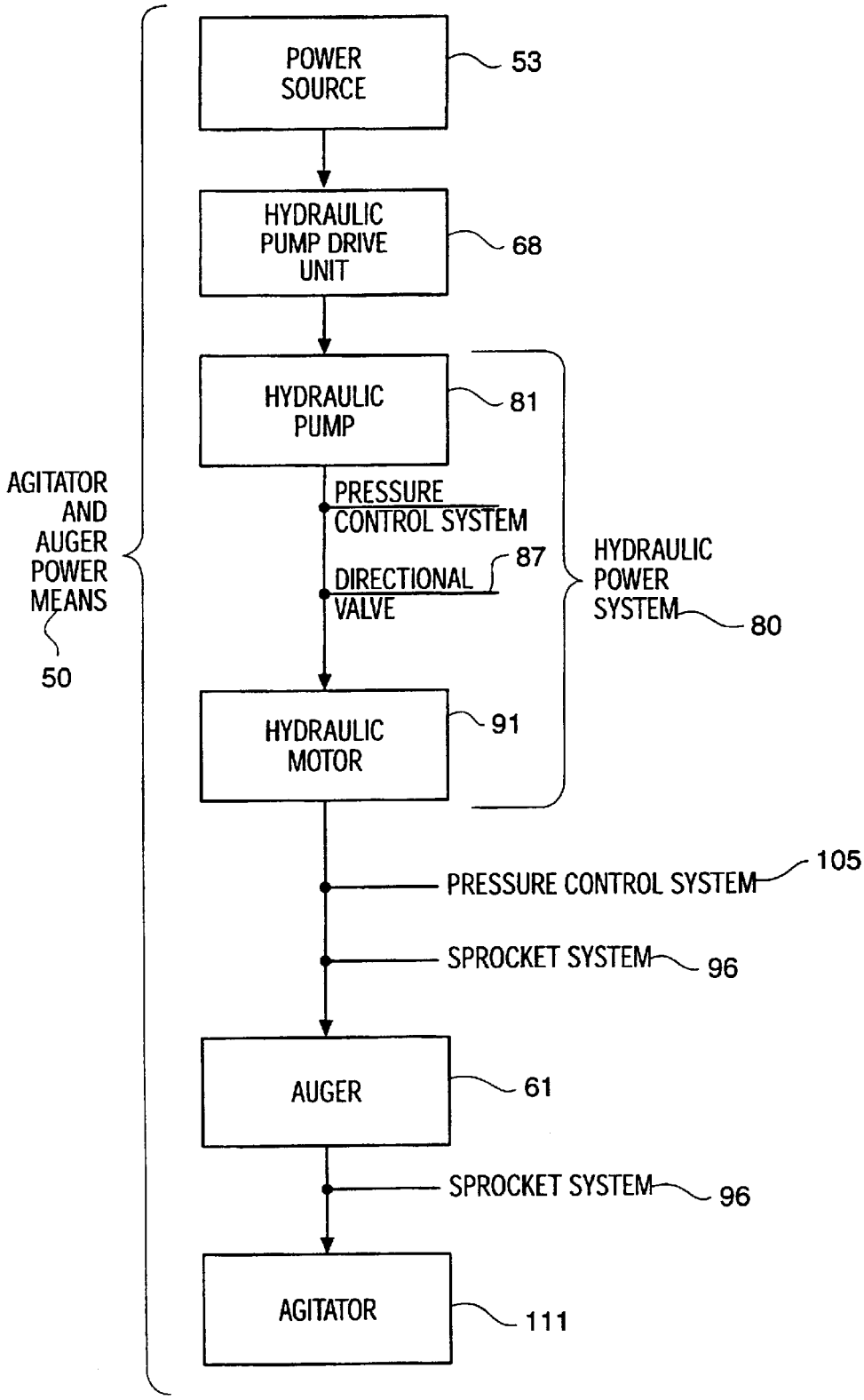
FIG. 11 is a block diagram of the power means.

Referring now to the drawings, FIG. 11 shows a block diagram of the auger and agitator power means 50, which includes a power source 53, a hydraulic pump drive unit 68, a hydraulic power system 80 (including a hydraulic pump 81 and a pressure control system 105) a hydraulic motor 91, an auger 61, a agitator 111, and a sprocket system 96. The power source is connected to the hydraulic power system 80 by the hydraulic pump drive unit 68. The hydraulic power system 80 is connected to the auger 61 and agitator 111 by the chain drive system 96, and is controlled by a three-position directional valve 87. The agitator and auger power means 50 achieves smooth delivery of fluent material to containers held by operators of the invention, and particularly facilitates operation of the invention when the fluent material is moist, which tends to clog the hopper's discharge chutes 11.

Figure 1:
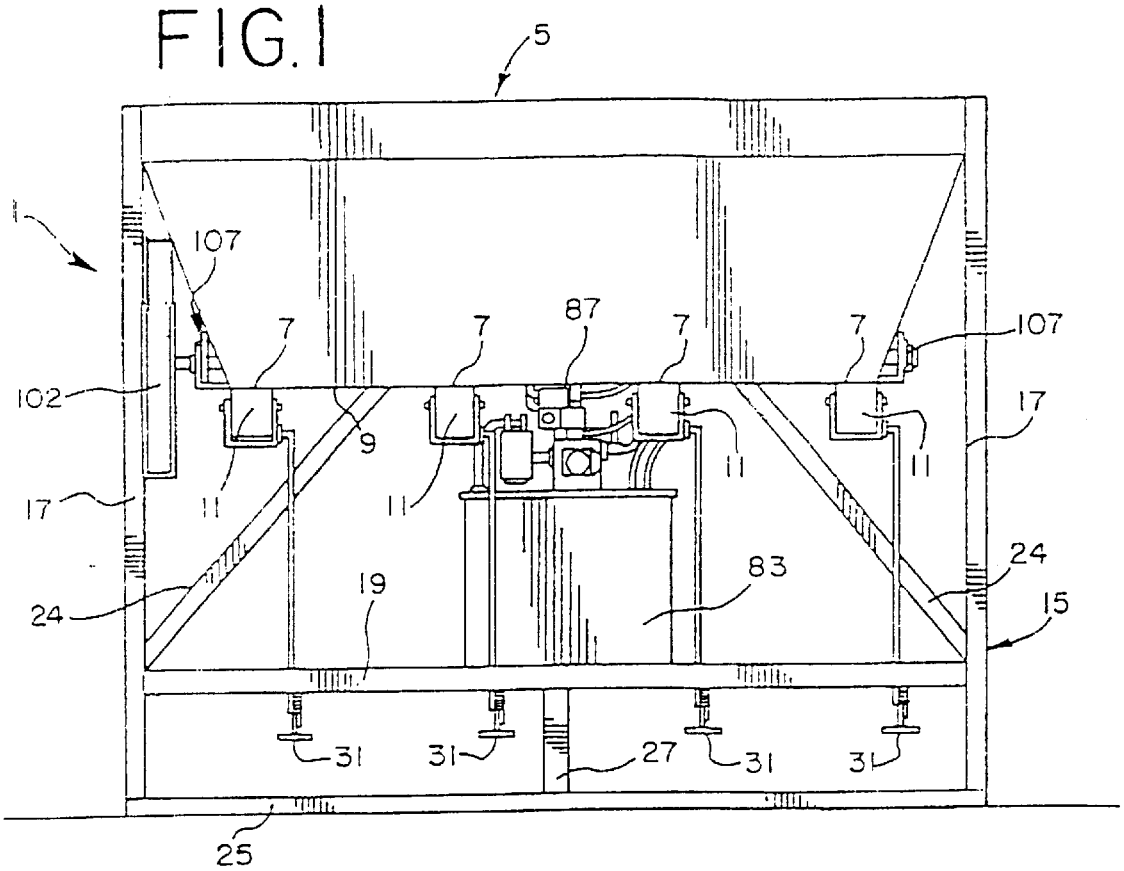
FIG. 1 is a side elevational view of a preferred embodiment of the invention showing the auger's power driving and hydraulic systems.

FIG. 1 shows a side elevational view of the apparatus 1 for dispensing fluent material into containers. The present invention comprises a hopper 3 having a preferably rectangular top opening 5 (FIGS. 1–4) for holding the fluent material. A safety grid 123 removably attached to the top opening 5 prohibits the entry of large objects, such as rocks or persons, into the hopper. The safety grid may comprise of a wire mesh system, a solid barrier, or any other means to prohibit entry into the hopper 3. In one embodiment, the hopper 3 is constructed of sheet metal. In alternative embodiments, the hopper 3 may be constructed of high-strength plastic, or any other lightweight yet strong material. The hopper 3 converges from its top opening downwardly generally to form a "V" shape as is seen in FIGS. 1–4 and 10. Individual discharge openings 7 are located at the bottom end of the hopper 9. Discharge chutes 11 are formed around each of the discharge openings 7 (FIGS. 1, 3) of the hopper 3 through which fluent material is guided into a receptacle 13 (FIG. 10: showing small boy holding receptacle), which may include a plastic or burlap bag, or any other receptacle. The hopper 3 may be loaded with fluent material from the top opening 5, and can be loaded by a front-end loader tractor, which is not shown in the drawings.

In one embodiment of the invention, the longitudinal dimension of the hopper 3 is greater than the width of the bucket of a standard front-end loader tractor and is approximately the length of a bed of a standard full-sized pickup truck. The lateral dimension of the hopper 3 is smaller than the longitudinal dimension of the hopper 3 and approximately the same size as the width of a bed of a standard full-sized pickup truck. However, in other embodiments of the invention the hopper 3 may be formed in other shapes and sizes.

The size of the discharge openings 7 is tailored to allow a relatively narrow stream of fluent material to be accurately and quickly dispensed from the hopper 3. In one embodiment of the invention, the discharge openings 7 are approximately seven inches across at their widest point.

The hopper 3 is supported by a support frame 15. The hopper 3 is mounted to the support frame 15 at each corner of the hopper 3. In one embodiment of the invention, the support frame 15 comprises four vertical legs 17 and includes a preferably horizontal, rectangular table 19 located below the hopper 3 providing strength to the support frame 15, as well as a resting place to hold the receptacles 13 to be filled and the main part of the auger power means 50, as is seen in FIGS. 1, 2, 4 and 5. Diagonal struts 23 that extend between the vertical legs 17 at each end of the hopper 3 and diagonal struts 24 that extend between the rear vertical legs 17 to a central location on the back of the hopper 3 provide rigidity and strength to the support frame 15. Additional support may alternatively be provided by at least two longitudinal base members 25 connecting the bottom of each vertical leg 17 and two short vertical legs 27 preferably extending from the table 19 to the longitudinal base members 25. For maximum strength and durability, the support frame 15, including the vertical legs 17, longitudinal base members 25, diagonal struts 23 and 24 and table 19, may be formed of high grade structural steel. Alternative embodiments may include any material with attributes of strength and rigidity.

In one embodiment of the invention, the flow and fluent material through the discharge chutes 11 is controlled by the multiple swing gates 29 can be actuated from a closed position to an open position by depressing the foot pedal 31, or other actuating means known in the art. The foot pedal 31 is connected to a lever arm 33 which, in one embodiment, is center-mounted to a lever arm pivot member 35 attached to the underside of the table 19 at the lever arm pivot point 37. The lever arm 33 is "V"-shaped, having an angle of approximately 135 degrees. Connected to the end of the lever arm 33, opposite of the foot pedal 31, is a vertical linkage rod 34 which freely pivots at the lower linkage rod connecting point 40. The linkage rod 34 passes through a hole in the table 19 and is connected at its upper end to the upper linkage rod connecting point 41 on one end of the swing gate arm 45, which allows the linkage rod 34 to pivot at its upper end as well. The opposite end of the swing gate arm 45 is connected to the swing gate 29 which pivots at the swing gate pivot point 51 to the open or closed position.

Figure 10:
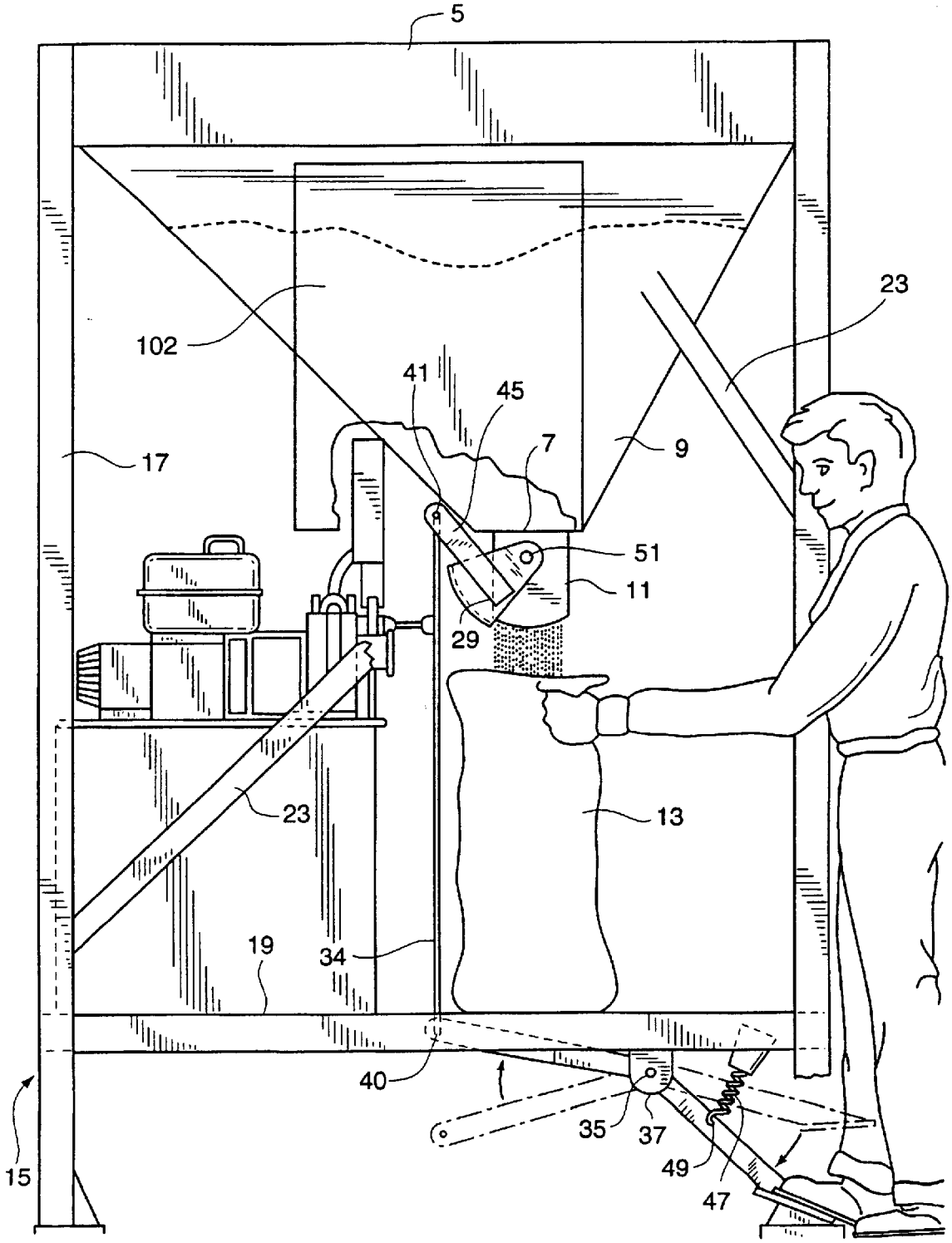
FIG. 10 is an end elevational view of the invention showing an operator filling a bag with fluent material by depressing the foot pedal.

The operation of the foot pedal 31 is shown in FIG. 10. In its resting-state position, the foot pedal 31 is held in an "up" position by tension in spring 47 attached at one end to the table 19 and at the other end to the lever arm 33 at a connecting point 49 on the lever arm 33, located between the foot pedal 31 and the lever arm pivot point 37, as can be viewed in FIGS. 2 and 10. The spring 47 may also comprise of an elastic material or other device that is capable of quickly returning the foot pedal to the up position.

Figure 2:
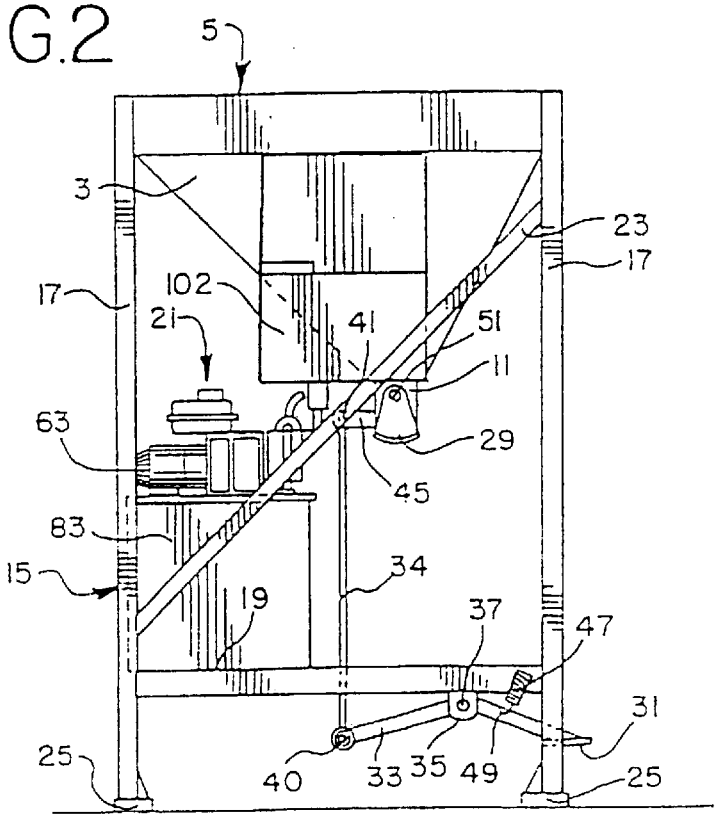
FIG. 2 is an end elevational view of the invention showing the chain drive system.

When the foot pedal 31 is in the "up" position, the rear of the lever arm 33 is in the "down" position, which in turn causes the linkage rod 34 to force the swing gate arm 45 to maintain the swing gate 29 in a closed position as can be viewed in FIG. 2. As a result, no fluent material can be discharged from the hopper 3 while this position is maintained.

As can be viewed in FIG. 10, to allow fluent material to pass through the discharge chute 11, and into the receptacle 13 below the discharge chute 11, the, operator must depress the foot pedal 31, thereby overcoming tension in spring 49. Lever arm 33 then rotates on lever pivot point 37, thereby causing the rear of the lever arm 33 to move upwards, which in turn pushes the linkage rod 34 vertically upwards. The linkage rod 34 rotates on the lower and upper linkage rod connecting point 41. As the linkage rod 34 pushes upwards, the swing gate arm 45 forces the swing gate 29 to pivot on swing gate pivot point 51.

As the swing gate 29 pivots to the open position, the swing gate 29 ceases to block the downward flow of fluent material from the hopper 3. When the operator releases the pressure on foot pedal 31, spring tension forces the foot pedal 31 to return to its resting-state position in which fluent material ceases to flow through the discharge chute 11. The foot pedal 31 may be depressed fully to open the swing gate 29 completely, thereby allowing maximum flow of fluent material, or the foot pedal 31 may be depressed partially to open the swing gate 29 only partially, thereby allowing a less rapid flow of fluent material. Other embodiments of the invention may incorporate other means known in the art selectively to block or cover the flow of material from the hopper.

AGITATOR AND AUGER AND POWER SYSTEM

The preferred embodiment of the agitator and auger power means 50 of the present invention is shown in FIGS. 4–9 and 11. The power source 53 comprises a gasoline engine 63 (FIG. 5), which may be five horse power, having a horizontal engine shaft 65 (FIG. 9). Any other power means known in the art, such as an electric, hydraulic, mechanical or solar-powered source may also be utilized. The hydraulic pump drive unit 68 may be seen in FIG. 9. The hydraulic pump drive unit 68 includes an engine shaft pulley 71, which in one embodiment is approximately two and one-half inches in diameter, and is connected to the horizontal engine shaft 65. A "V"-shaped belt 69 is connected to the engine shaft pulley 71, and drives the driven shaft pulley 71, which in one embodiment is five inches in diameter. The driven shaft pulley 67 is connected to and rotates on the driven shaft 73. The driven shaft 73 rotates on two opposing flange mounted bearings 75 (only one is shown in FIG. 9). The driven shaft 73 is in one embodiment three-quarters of an inch in diameter. One side of the flexible shaft coupler 70 is connected to one end of the driven shaft 73. The other end of the flexible shaft coupler 70 is connected to a hydraulic pump shaft 74. This hydraulic pump drive unit 68, which may incorporate the above elements, may alternatively be a sprocket system or other power transmission system known in the art.

Figure 6:
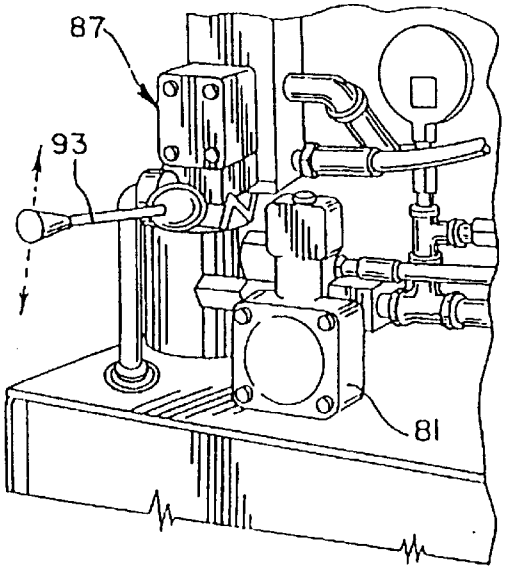
FIG. 6 is a partial perspective view of the front of the hydraulic system showing the three-way valve lever and hydraulic pump.

The hydraulic pump shaft 74 is connected to and a part of hydraulic pump 81, which is shown in FIG. 6. In one embodiment of the invention, the hydraulic pump 81 is preferably a Nachi model number which is mounted on the hydraulic pump drive unit 68. The engine 63 and hydraulic pump drive unit 68 are mounted on top of a hydraulic oil reservoir 83. In one embodiment, the hydraulic oil reservoir 83 may contain 20 gallons of hydraulic fluid. The hydraulic oil reservoir 83 acts both as a source to hold the hydraulic fluid and a means to dissipate heat generated by the hydraulic power means 59. Though such a large reservoir is not absolutely necessary, it has the attribute of having greater heat transfer, and thus cooling ability than a smaller reservoir. The hydraulic pump 81 is preferably a variable displacement pressure-compensated pump, which controls the system's pressure, and thus, operates as the pressure control system 105, and has the capacity to pump five gallons of hydraulic fluid per minute.

Figure 5:
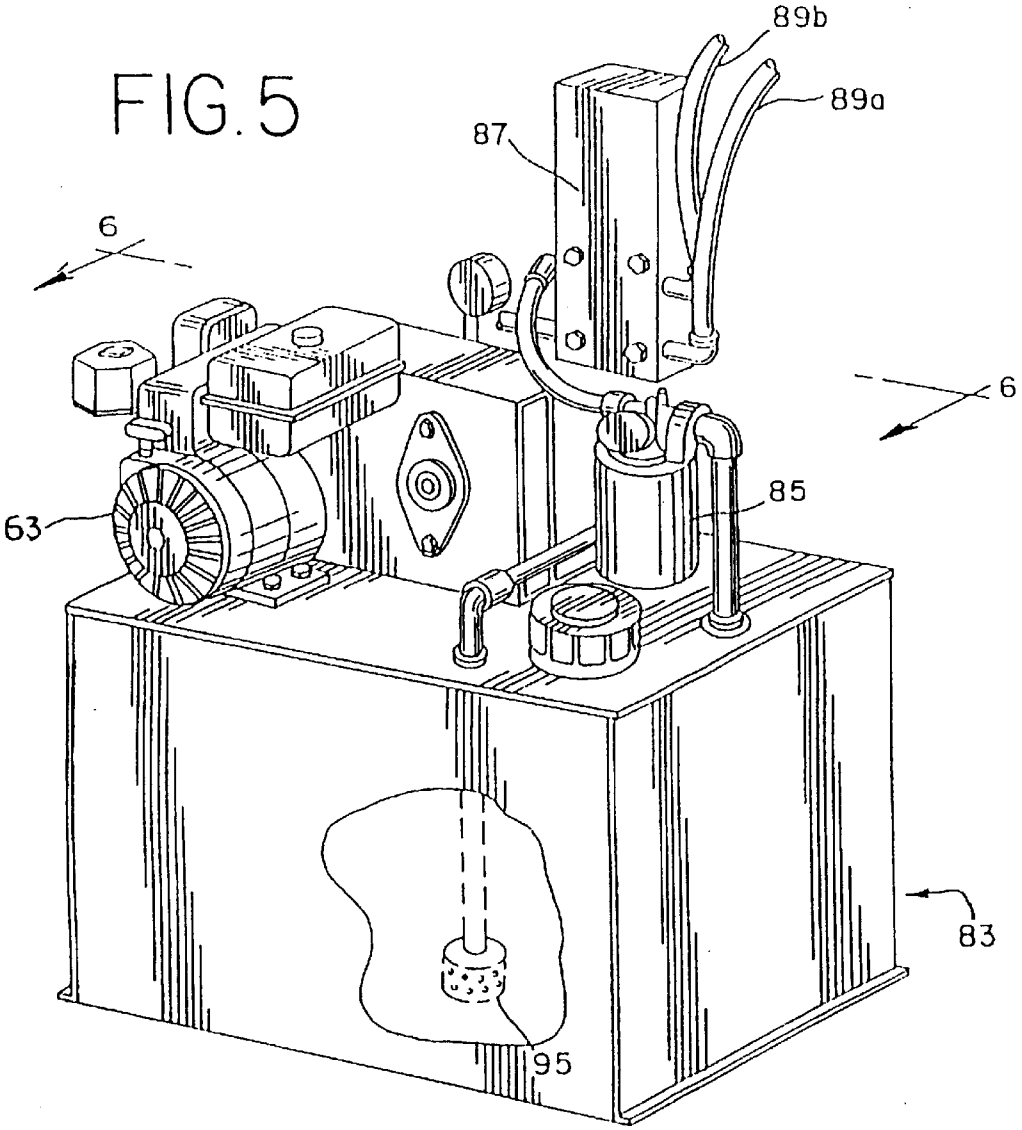
FIG. 5 is a rear exterior perspective view of the power source and hydraulic fluid reservoir.

The hydraulic pump 81 pulls oil from the hydraulic oil reservoir 83 through a suction strainer 95 and delivers it at a maximum of 2000 p.s.i. to a control valve, which in one embodiment is a manually operated three-position valve 87, preferably a Nachi model DMA-G01-F4-10 (FIGS. 5 and 6). The three-position valve 87 directs the hydraulic fluid through the two hydraulic motor feed hoses 89(*a–b*) in either direction, or not at all. The hydraulic motor feed hoses 89(*a–b*) which are connected to the hydraulic motor 91, shown in FIG. 7, which may be a White Model No. RS-04-04-01-0. Moving the three-position valve lever 93 to the "up" position causes the hydraulic motor to rotate in a clockwise direction by directing fluid from the three-position valve 87 through the hydraulic motor 91, back to the three-position valve 87, through the return oil filter 85 and finally into the hydraulic oil reservoir 83. When the three-position valve lever 93 is moved to the "down" position, hydraulic fluid is directed in the opposite direction through the hydraulic motor 91 as described above, thus, causing the hydraulic motor 91 to rotate in a counter-clockwise direction.

Figure 3:
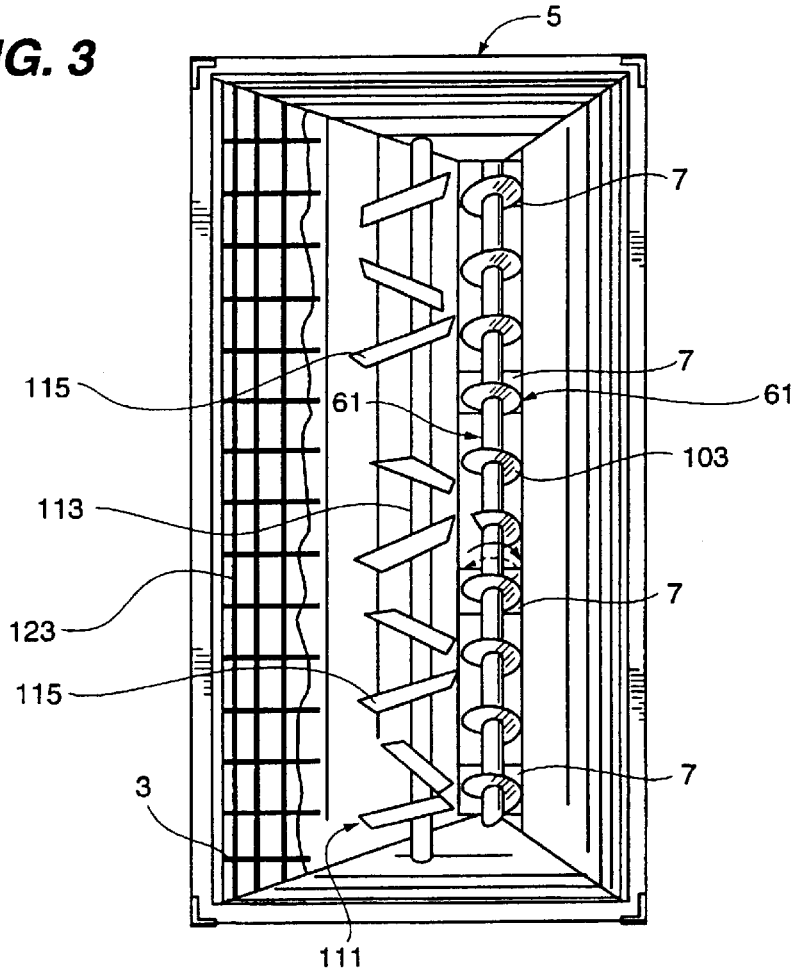
FIG. 3 is a top view of the invention showing the interior of the hopper, the construction of the auger and agitator, and a cut-away view of the safety grid.
Figure 4:
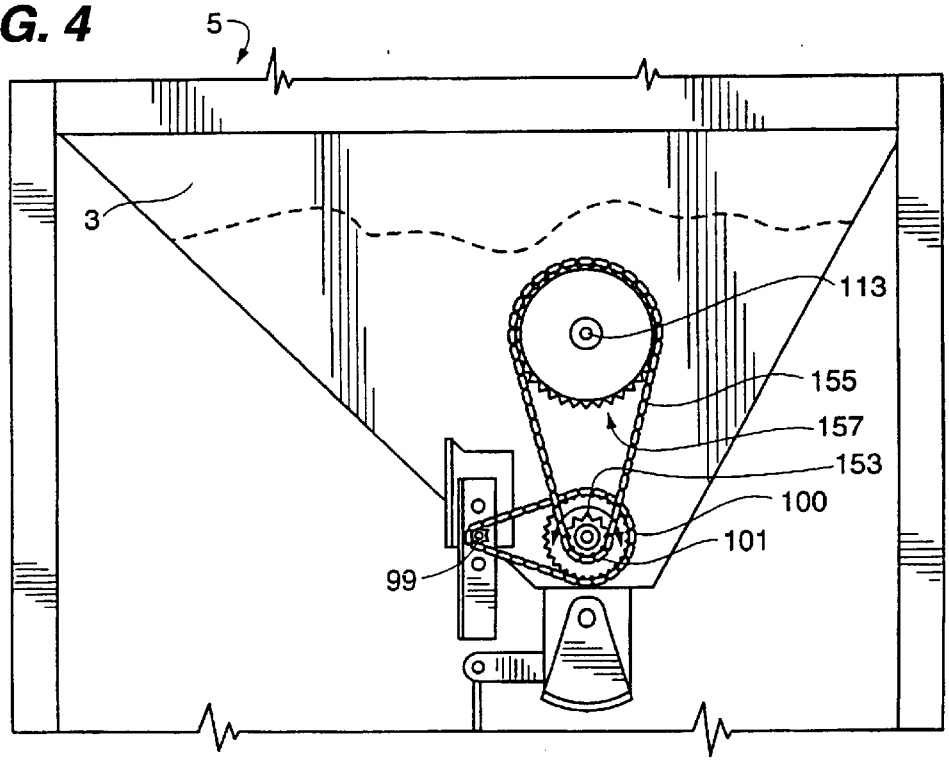
FIG. 4 is an end view of the hopper showing the drive system.

As shown in FIGS. 8 and 9, the hydraulic motor 91 includes a hydraulic motor shaft 97 (not shown in the drawings), which is connected to and drives a sprocket system 96. The sprocket system includes a hydraulic motor sprocket 99, which is connected to the hydraulic motor shaft 97. The hydraulic motor sprocket 99 is connected to and drives a sprocket roller chain 100 which, in turn, is connected to and drives an auger sprocket 101. The auger sprocket 101 is connected to the driven end of the auger 61. The reduction ratio between the hydraulic motor sprocket 99 and the auger sprocket 101 is preferably four-to-one and delivers approximately 350 lbs-ft of torque to the auger 61. The agitator 111 is driven by the sprocket system 96 which may include a reduction chain drive 121 configuration and auger drive shaft 151 as is seen in FIGS. 3 and 4. A second sprocket 153 mounted on the auger shaft 113 may drive a second sprocket roller chain 155, which in turn drives an agitator sprocket 157 mounted on the agitator shaft 113. Preferably the reduction chain drive 121 is geared at a three-to-one ratio. The sprocket system 96 is covered by sprocket system cover 102 (FIG. 2) to protect the sprocket system 96 from dirt and moisture, as well as to provide a safety shield for safe operation of the apparatus.

The auger 61 is preferably a model 6H308 RH or 6H308 LH supplied by the Screw Conveyor Corporation of Hammond, Ind., having auger blades 103 (FIG. 7). The auger 61 may be customized by providing a bi-directional sectional flighting in the auger blades 103 as shown in FIG. 3, which in one embodiment may be approximately six inches in diameter. The auger 61 is mounted on two auger bearings 107, which are attached to either end of the lower portion of the hopper 3. Other auger designs and flighting sizes may alternatively be utilized.

As seen in FIG. 3, the agitator 111 may be constructed in various configurations to accomplish the aim of churning the fluent material. In one embodiment, the agitator 111 includes an agitator shaft 113 which is two-and-a-half inches (2½") in diameter with multiple agitator blades 115 welded on the agitator shaft 113 giving the agitator 111 a total diameter of approximately 18". The agitator blades 115 may be of any configuration which effectively churns the fluent material without coming into contact with the auger 61 or the sides of the hopper 3. The agitator 111 may be mounted on two agitator bearings 117 that may be located on the ends of the hopper 3 and relatively above the auger bearings 107. The agitator 111 may rotate at approximately 15 rotations per minute, in harmony with the auger 61, so that the agitator 111 constantly breaks up fluent material and moves the fluent material to the auger 61 so that an even and constant flow of fluent material reaches the auger 61 and discharge openings 7. As the load on the auger 61 and agitator 111 increases the hydraulic fluid pressure increases. When the pressure reaches the maximum pressure setting, which in one embodiment is 1750 p.s.i. the pressure control system 105 ceases the flow of the hydraulic fluid which causes the auger 61 and agitator 111 to stop rotating. This may occur when all swing gates 29 remain in the closed position. When one or more of the swing gates 29 is opened, the auger 61 begins to rotate due to the decreased resistance and as a result, the hydraulic oil pressure drops below 1750 p.s.i., hydraulic fluid begins to flow again thereby continuing to drive the hydraulic motor 91. In other words, the greater the load there is on the auger 61 and agitator 111, the greater the amount of torque necessary to drive the auger 61 and agitator 111. This pressure control system 105(FIG. 11), which is incorporated in the version of the hydraulic pump disclosed herein, acts as a safety means to control the upper limit of torque exerted on the auger 61 and agitator 111, as well as to control the maximum pressure in the hydraulic power system 80. In other embodiments of the invention, other known pressure control system 105 may interface with the power source 53, the hydraulic power system 80 and the auger 61 and agitator 111 to implement the same function as described herein, including an electrical, computer, or electromechanical control system. Also, in other embodiments of the invention, the hydraulic pump 81 does not shut off at any particular pressure level, or alternatively shuts off at pressure level greater or less than 1750 p.s.i.

The embodiment of the invention disclosed herein has been discussed for the purpose of familiarizing the reader with novel aspects of the invention. Although a preferred embodiment of the invention has been shown and described, many changes, modifications and substitutions may be made by one having ordinary skill in the art without necessarily departing from the scope of the invention.

We claim:

1. A fluent material dispensing apparatus for filling containers with fluent material comprising:

(a) a hopper having an top and a closed bottom, being adapted to receive and hold fluent material, and having multiple discharge openings at the hopper's bottom;

(b) multiple discharge chutes, each having a top end located adjacent one of the discharge openings;

(c) a support frame for supporting the hopper above ground;

(d) gate means associated with each discharge chute, the gate means being movable from a chute open position and a chute closed position to control the discharge of fluent material from the hopper;

(e) gate actuating means for selectively moving the gate means between the chute open position and the chute closed position;

(f) rotatable auger means mounted to the hopper for moving fluent material over the discharge openings, the auger extending substantially the length of the hopper;

(g) rotatable agitator means mounted to the hopper to ensure a steady flow of material to the auger and discharge openings; and, (h) power means for rotating the auger means and for rotating the agitator means within the hopper to move the fluent material over the discharge openings and to unblock any clogged discharge opening.

2. The fluent material dispensing apparatus of claim 1 wherein the gate actuating means includes a foot pedal mounted to one end of a lever arm having two ends, the lever arm being pivotally mounted to a pivot point, wherein the food pedal actuates the gate means without the use of the operators' hands.

3. The fluent material dispensing apparatus of claim 2, wherein the gate actuating means includes a linkage rod having two opposing ends pivotally connected at the end of the lever arm opposite the foot pedal, the other end of the linkage rod being pivotally connected to the gate means, whereby, when the food pedal is depressed, the lever arm pushes the linkage rod, which in turn upwardly pushes the gate arm, which in turn pivots the gate means to selectively open the discharge chute.

4. The fluent material dispensing apparatus of claim 3, wherein the gate actuating means includes a spring means for quickly returning the foot pedal to an at rest position upon the release of the foot pedal, whereby the gate means returns to the closed position covering the discharge opening.

5. The fluent material dispensing apparatus for filling containers with fluent material comprising:

(a) a hopper, having a top and bottom, for receiving and holding fluent material, the hopper's top being open and the hopper converging downwardly in a "V" shape towards the hopper's bottom, and having multiple discharge openings at the hopper's bottom;

(b) a safety grid over the top opening to prohibit the entry of large objects into the hopper;

(c) multiple discharge chutes having top and bottom ends for dispensing fluent material, the top end of the discharge chutes being formed around each of the discharge openings;

(d) a support frame for supporting the hopper, the support frame comprising base members, a plurality of vertical legs extending between the hopper and the base members and a table located below the hopper connected to the plurality of base members;

(e) gate means associated with each discharge chute, the gate means being movable from a chute open position to a chute closed position for selectively opening and closing the discharge chute to control the discharge of fluent material from the hopper;

(f) gate actuating means for selectively moving the gate means between the chute open position and the chute closed position, the gate actuating means including a mechanism, operable by an operator, for enabling an operator to selectively open or close the discharge chute;

(g) spring means for quickly returning the mechanism to an at rest position upon release of the mechanism by an operator;

(h) rotatable auger means mounted in the hopper on auger bearings for moving fluent material over the discharge openings, the auger extending substantially the length of the hopper;

(i) rotatable agitator means mounted on agitator bearings in the hopper to ensure a steady flow of material to the auger, the agitator means comprising an agitator shaft and agitator blades attached thereto, and the agitator means being mounted relatively above the auger means; and (j) agitator and auger power means for rotating the agitator means and auger means within the hopper to move the fluent material over the discharge openings and to unblock any clogged discharged opening, the agitator and auger power means including a power source adapted to be connected to a hydraulic power system adapted to be connected to the auger means.

6. A fluent material dispensing apparatus for filling containers with fluent material comprising:

(a) a hopper, having a top and bottom, for receiving and holding fluent material, the hopper's top being open and the hopper converging downwardly in a "V" shape towards the hopper's bottom, wherein multiple discharge openings are located at the hopper's bottom;

(b) a safety grid over the top opening to prohibit the entry of large objects into the hopper;

(c) multiple discharge chutes having top and bottom ends for dispensing fluent material, the top end of the discharge chutes being formed around each of the discharge openings;

(d) a support frame for supporting the hopper, the support frame comprising base members, a plurality of vertical legs extending between the hopper and the base members, diagonal struts extending between the vertical legs, the hopper and base members, and a table located below the hopper connected to the plurality of base members;

(e) gate means associated with each discharge chute, the gate means being movable from a chute open position to a chute closed position for selectively opening and closing the discharge chute to control the discharge of fluent material from the hopper;

(f) a linkage structure fixed to the gate means;

(g) gate actuating means for selectively moving the gate means between a chute open position and a chute closed position including a foot pedal mounted to one end of the linkage structure, the other end of the linkage structure being connected to the gate means, whereby when the foot pedal is depressed, the linkage structure selectively opens and closes the discharge chute;

(h) spring means for quickly returning the foot pedal to an at rest position upon release of the foot pedal;

(i) rotatable auger means mounted in the hopper on auger bearings for moving fluent material over the discharge openings, the auger extending substantially the length of the hopper;

(j) rotatable agitator means mounted on agitator bearings in the hopper for moving a steady flow of material to the auger means, the agitator means extending substantially the length of the hopper and parallel to and relatively above the auger means;

(k) agitator and auger power means for rotating the auger means and agitator means within the hopper to move the fluent material over the discharge openings and to unblock any clogged discharge opening, the agitator and auger power means including a small-bore engine power source which is adapted to be connected to a hydraulic pump drive unit means for transmitting power from the power source to a hydraulic power system, the hydraulic power system being adapted to be connected to a sprocket system means for rotating the auger and agitator;

(l) directional control means for selectively changing the rotational direction of the auger and agitator means and for selectively changing the auger and agitator to a non-rotational state; and (m) pressure control means for limiting the pressure within the hydraulic power system.

7. The fluent material dispensing apparatus of claim 6, wherein the hydraulic power system comprises a hydraulic pump adapted to be connected to a hydraulic motor, the hydraulic pump being driven by the power source, and in turn the hydraulic motor being driven by the hydraulic pump.

8. The fluent material dispensing apparatus of claim 6, wherein the hydraulic power system includes a three-way valve for allowing fluid to flow within the closed system in either of two direction, or to block fluid flow altogether, and having a lever adapted to be connected to the three-way valve for selectively controlling the direction of the flow of hydraulic fluid o the hydraulic motor.

9. A fluent material dispensing apparatus for dispensing fluent material comprising:

hopper means for receiving and holding, subsequent to discharge, a quantity of fluent material and having a generally open top and a generally closed bottom;

at least one fluent material discharge chute which is connected to said bottom of said hopper means, which extends downwardly from said bottom and which has an upper material receiving opening and a lower material discharge opening;

means for supporting said hopper means above ground;

means for blocking and unblocking said at least one discharge chute including a plate reciprocal in a path which contains said plate and which extends laterally, transversely across said at least one discharge chute, in a generally horizontal direction across said chute, between a chute blocking position and a chute unblocking position;

engageable structure coupled to said Plate and being constructed and arranged for being engaged for reciprocating said plate in said path extending generally horizontally across said chute;

rotatable auger means adjacent the bottom of said hopper means for moving fluent material over said at least one discharge chute;

rotatable agitator means including a rotatable shaft and two or more blades or tines extending generally outwardly from said shaft mounted in said hopper means above said auger means for agitating fluent material received in said hopper means; and, power means for rotating said auger means and for rotating said agitator means within said hopper means.

* * * * *